United States Patent [19]

Flynn et al.

[11] Patent Number: 4,947,195

[45] Date of Patent: Aug. 7, 1990

[54] LED PRINTER

[75] Inventors: James T. Flynn; Yee S. Ng, both of Fairport, N.Y.

[73] Assignee: Eastman Kodak Company, Rochester, N.Y.

[21] Appl. No.: 375,153

[22] Filed: Jul. 3, 1989

[51] Int. Cl.[5] ..... G01D 15/00

[52] U.S. Cl. ..... 346/155; 346/160

[58] Field of Search ..... 346/160, 107 R, 108, 346/155, 139 C; 358/300, 302

[56] References Cited

U.S. PATENT DOCUMENTS 3,850,517 11/1974 Stephany et al. ..... 346/155
4,435,064 3/1984 Tsukada et al. ..... 346/107 R
4,749,120 6/1988 Hatada ..... 346/155

FOREIGN PATENT DOCUMENTS 63-33762 7/1986 Japan ..... 346/160
62-204565 11/1986 Japan ..... 346/160

*Primary Examiner*—Arthur G. Evans
*Attorney, Agent, or Firm*—Norman Rushefsky

[57] ABSTRACT

An LED printer includes a gradient index lens array for focusing light from the LED's onto an image recording surface positioned at the image plane of the lens. A diffusion plate such as a ground glass plate is placed at the object plane of the lens array. Light from the LED's are slightly diffused by the ground glass plate and improved overlap of exposed pixels results. In one embodiment of the invention, the LED's are mounted on the plate on a "flip-chip" arrangement.

17 Claims, 1 Drawing Sheet

LED PRINTER

BACKGROUND OF THE INVENTION

1. Field of the Invention

The present invention relates to non-impact printing apparatus using a multiple number of electro-optical recording elements, such as an LED printhead used for recording in an electrophotographic system.

2. Description Relative to the Prior Art

In the prior art as exemplified by U.S. Pat. No. 4,435,064, light-emitting diode (LED) printheads are known for use in recording on electrophotographic receptors such as photoconductive drums or webs. By selective enablement of the LED's, images may be recorded, developed, and subsequently transferred to a copy sheet such as plain paper.

As the LED's are known to be lambertian light emitters, it is known to provide a lens to focus light from the LED's onto the recording surface. This allows the LED's to be moved away from direct engagement with the recording medium. One lens that may be used is known as a Selfoc lens, which is a linear array of gradient indexed optical fibers. The lens is positioned between the recording medium and the LED printhead. A problem with the use of LED arrays is that the arrays are each formed in chips of 64, 96 or 128 LED's and then must be butted together end-to-end to provide a single row of several thousand LED's. While the LED to LED spacing remains uniform between LED's on the same chip, it can vary for adjacent chips at the ends of butting arrays. Furthermore, the spacing between chips on the same array chip can be relatively large. The LED printheads are used in electrophotographic systems to erase charge from the photoconductor, problems can arise due to the inability of the charge to be uniformly erased. The result can be streaks in the background (pos/pos) systems or distorted characters and lines (neg/pos) systems or a combination of both deleterious effects can be seen in either system.

It will be understood that a perfect optical image of the LED projected to the photoconductor is undesirable because the LED light sources in the array are not contiguous. The gaps in the array would leave white or black gaps in the developed image. Overlap of the light from the LED's in the array is required to achieve coverage of the full area of the photoconductor.

In order to overcome this problem, the shape of the LED's may be changed and/or the images thereof varied by moving the LED's slightly from the object plane or by moving the lens. While this defocussing approach can be satisfactory and is commonly used, there are problems associated with same since devices for moving either array must do so without moving one end more than the other. Additionally, the shape of the LED elements may not be best suited for the printing application described above. In addition, a significant defocussed position of the Selfoc lens can form multiple images of a picture element instead of a single image.

It is therefore one object of the invention to provide an improved printhead which overcomes the disadvantages of the prior art.

SUMMARY OF THE INVENTION

This and other objects are realized by a non-impact printer apparatus comprising a photosensitive recording medium; a recording head having a plurality of light producing recording elements adapted to be selectively activated for recording on the recording medium; a lens for focusing light from the recording elements onto the recording medium, the recording medium being located at the image plane of the lens; and a diffusion plate means located at the object plane of the lens array for diffusing light from the recording elements.

In another aspect of the invention, non-impact printer apparatus is provided comprising a photosensitive recording medium; a recording head having a plurality of light producing recording elements adapted to be selectively activated for recording on the recording medium; a lens for focusing light from the recording elements onto the recording medium, and a diffusion plate means for diffusing light from the recording elements before light impinges upon the recording medium; and means for supporting the recording elements upon one surface of the diffusion plate.

DESCRIPTION OF THE DRAWINGS

The accompanying

DESCRIPTION OF THE PREFERRED EMBODIMENT

Because electrophotographic apparatus of the general type described herein are well known, the present description will be directed in particular to elements forming part of or cooperating more directly with, the present invention.

Figure 1:
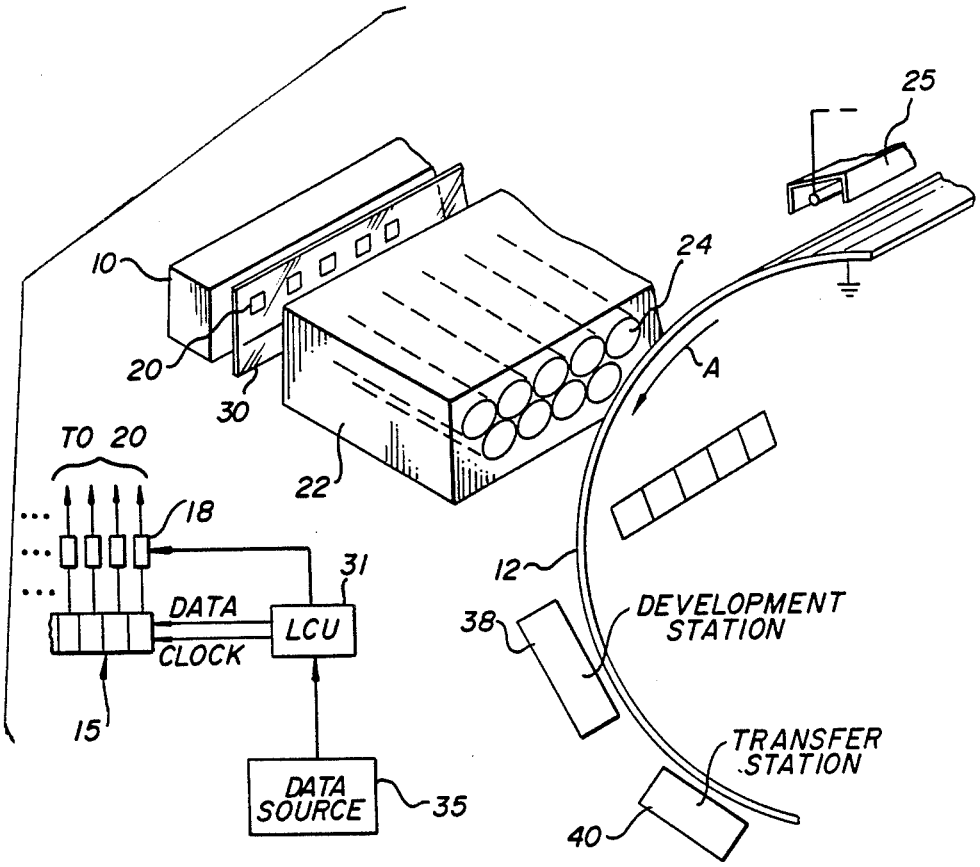
FIG. 1 is a view in perspective of a schematic representation of a printer apparatus forming one embodiment of the invention.

The apparatus for the herein disclosed invention is typified by the diagram of the accompanying FIG. 1, a printhead 10 includes a linear array of several thousand triggerable radiation sources; e.g. LED's 20, disposed to expose selectively a photosensitive image-receiver medium 12 that is movable relative to the array in the direction of arrow A by suitable conventional means (not shown). Optical means 22 for focusing the LED's for exposure onto the medium is also provided. In this regard, gradient index optical fiber devices 24 such as Selfoc (trademark of Nippon Sheet Glass Co., Ltd.) arrays are highly suited. The LED's of the array are triggered into operation by means of image processing electronics that are responsive to image signal information. Depending on the duration for which any given LED is turned on, the exposure effected by such LED is more or less made. Where the medium 12 is an electrophotographic receptor, the LED's may be used to form an electrostatic image on a uniformly electrostatically charged photoconductor and this image developed using opaque toner particles and perhaps transferred to a copy sheet, see U.S. Pat. No. 3,850,517, the contents of which are incorporated herein by this reference.

A uniform electrostatic charge is provided on the photoconductive member 12 by a corona charger device 25. The uniform charge is then modulated with image information (either the actual structure of the image or its complement) by selective activation of appropriate LED's. Data source 35, such as a computer or image scanner, provides image signals to a logic and control unit 31 that includes the aforementioned image processing electronics. Data to be printed for each line is in the form of binary digital signals; i.e., 1's and 0's. This data is serially shifted into one or more shift registers 15 that are used to store a line of image pixels or picture elements of data. At an appropriate time, selective drivers 18 are activated to drive current to the corresponding LED's to be energized. The shift registers and drivers are fabricated in the form of integrated circuit chips and these chips are mounted on the printhead. Light from the LED's impinges upon a diffusion plate such as a ground glass plate 30. This plate is located at the object plane of the Selfoc lens array 22. The defocused image of the LED's as projected onto the glass plate is then imaged upon the photoconductor drum 12 or a photoconductive web.

The development station 38 is conventional and if of the pos-pos type, includes toner particles of opposite polarity of that to which the photoconductive receptor is uniformly charged. The toner particles tend to develop upon the photoconductive receptor at locations where charge remains. Thus, the image data provided for exposure of the LED's are such as to erase background areas. In a neg-pos type, the toner particles are of similar polarity to that of the photoconductive receptor and the toner particles tend to develop upon the receptor at locations where the electrostatic charge is reduced by the exposure.

After development, the developed image is transferred to a copy sheet of, say, plain paper at a conventional transfer station 40. The developed image on the copy sheet may then be fused to permanently fix same to the copy sheet. The electrophotographic receptor is then cleaned and prepared for reuse in accordance with known techniques.

Figure 2:
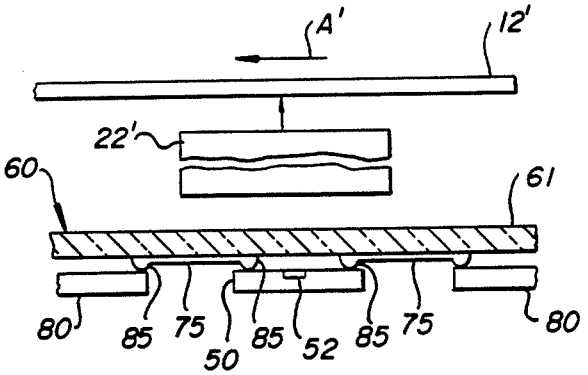
FIG. 2 is a schematic elevational view in cross-section of another embodiment of printer apparatus of the invention.

In the embodiment of FIG. 2, similar elements to that shown and described for FIG. 1 are noted with a prime (′). The circuit members comprising the LED printhead are mounted in a "flip-chip" manner upon a glass substrate 60. In this embodiment, metal traces 75 comprising electrical leads are printed upon one surface of the glass support. Microbumps 85 of metal are formed upon the respective chips, such as driver chips 80 and LED array chips 50. These bumps serve to mount and space the chips from one surface of the glass support. Reference may be had to U.S. Pat. No. 4,749,120, the contents of which are incorporated herein by this reference. Any binder used to secure the chips to the support may be transparent so as not to intefere with light from the LED's 52 or provision made to block this binder from reaching the light-emitting area of the LED's. In the Figure shown, the LED chip arrays 50 are arranged end to end to form a continuous row of LED's and such row would be perpendicular to the plane of the figure. Surface 61 is provided with a treatment to cause this surface to have a ground glass appearance. Light from the LED's, as in the embodiment described in FIG. 1, is somewhat dispersed and provides a larger pixel size. The ground glass surface 61 is placed at the object plane of the Selfoc lens array 22′ and light from the LED's and emanating from this surface are imaged by the Selfoc lens upon photoconductor 12, whose surface is placed at the image plane of the Selfoc lens.

While the invention has been described with reference to LED's, other emitters contemplated include liquid crystal devices, PLZT displays, etc.

There has thus been disclosed an improved printer apparatus wherein improved overlap of pixels is created which is particularly suited for erasure of background areas in electrophotographic processes involving pos-pos type of development. In addition, smoother and more uniform exposures are provided for character and line formation in neg/pos systems.

A further advantage is provided by the invention in that smaller LED's may be used with the invention; i.e., LED's having smaller light-emitting areas. As the current density in an LED increases, the brightness goes up as long as the surface resistance in the array is not too high. This situation favors a smaller LED (driven by the same current) which has a smaller surface resistance between its drive electrode and the whole LED active region. However, without the diffusion plate, if the LED pixel area is too small, the SELFOC lens may not spread the light spot to be big enough to cover the area on the film plane required for suitable exposure. The use of smaller LED's also facilitates scribing; i.e., the cutting up into LED chip arrays of the silicon disks upon which the LED's are fabricated. If an LED pixel gets too big, scribing accuracy needs to be better so as not to damage the end pixels of each array. With the apparatus of the invention, the use of smaller LED's is facilitated providing more free space between LED's to facilitate scribing.

While the invention has been described with particular reference to preferred embodiments thereof, it will be understood that variations and modifications can be effected within the spirit and scope of the invention.

We claim:

1. A non-impact printer apparatus comprising a photoconductive recording medium having an electrostatic charge;

a recording head having a plurality of light producing recording elements adapted to be selectively activated for recording on the recording medium;

a lens array including a plurality of gradient index fiber optic elements for focusing light from the recording elements onto the recording medium, the recording medium being located at the image plane of the lens array; and a diffusion plate means located at the object plane of the lens array for diffusing light from the recording elements.

2. The apparatus of claim 1 and wherein the recording elements are light-emitting diodes.

3. The apparatus of claim 2 and wherein the light-emitting diodes are arranged in a single row.

4. The apparatus of claim 1 and including means for developing the image on the recording medium in areas of the image not receiving exposure.

5. The apparatus of claim 4 and wherein the plate is a ground glass plate.

6. The apparatus of claim 1 and wherein the plate is a ground glass plate.

7. The apparatus of claim 1 and wherein the recording elements are mounted upon one surface of the diffusion plate.

8. A non-impact printer apparatus comprising a photosensitive recording medium;

a recording head having a plurality of light producing recording elements adapted to be selectively activated for recording on the recording medium;

a lens for focusing light from the recording elements onto the recording medium, the recording medium being located at the image plane of the lens; and a diffusion plate means located at the object plane of the lens array for diffusing light from the recording elements.

9. The apparatus of claim 8 and wherein the recording elements are light-emitting diodes.

10. The apparatus of claim 8 and wherein the plate is a ground glass plate.

11. The apparatus of claim 8 and wherein the recording elements are mounted on the diffusion plate.

12. The apparatus of claim 11 and wherein the recording elements are formed on chips and mounted to one surface of the plate in a flip-chip arrangment and another surface of the plate is ground glass.

13. The apparatus of claim 12 and wherein the recording elements are light-emitting diodes.

14. The apparatus of claim 8 and wherein the lens is a gradient index lens array.

15. A non-impact printer apparatus comprising a photosensitive recording medium;

a recording head having a plurality of light producing recording elements adapted to be selectively activated for recording on the recording medium;

a lens for focusing light from the recording elements onto the recording medium, and a diffusion plate means for diffusing light from the recording elements before light impinges upon the recording medium; and means for supporting the recording elements upon the surface of the diffusion plate.

16. The apparatus of claim 15 and wherein the recording elements are formed on chips and are mounted to one surface of the plate in a flip-chip arrangement and another surface of the plate is ground glass.

17. The apparatus of claim 16 and wherein the recording elements are light-emitting diodes.

* * * * *